US010154765B2

(12) United States Patent
Khalil

(10) Patent No.: US 10,154,765 B2
(45) Date of Patent: Dec. 18, 2018

(54) VACUUM CLEANER INCLUDING A REMOVABLE CANISTER ASSEMBLY

(71) Applicant: Techtronic Floor Care Technology Limited, Tortola (VG)

(72) Inventor: David Khalil, Highland Heights, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 439 days.

(21) Appl. No.: 14/599,016

(22) Filed: Jan. 16, 2015

(65) Prior Publication Data

US 2015/0201817 A1 Jul. 23, 2015

Related U.S. Application Data

(60) Provisional application No. 61/928,708, filed on Jan. 17, 2014.

(51) Int. Cl.
*A47L 5/32* (2006.01)
*A47L 5/22* (2006.01)
(Continued)

(52) U.S. Cl.
CPC ..... *A47L 5/32* (2013.01); *A47L 5/225* (2013.01); *A47L 5/30* (2013.01); *A47L 9/2868* (2013.01)

(58) Field of Classification Search
CPC ..... A47L 5/32; A47L 5/225; A47L 9/2868; A47L 5/30
See application file for complete search history.

(56) References Cited

U.S. PATENT DOCUMENTS 5,309,600 A * 5/1994 Weaver ..... A47L 5/00 15/323
5,524,321 A 6/1996 Weaver et al.
(Continued)

FOREIGN PATENT DOCUMENTS

CN 1568885 1/2005
CN 1806743 7/2006
(Continued)

OTHER PUBLICATIONS

International Search Report and Written Opinion for Application No. PCT/US2015/011796 dated Apr. 8, 2015 (33 pages).

*Primary Examiner* — Robert Scruggs
(74) *Attorney, Agent, or Firm* — Michael Best & Friedrich LLP

(57) ABSTRACT

A vacuum cleaner includes a surface cleaning head, a pivot assembly pivotally coupled to the surface cleaning head, a cleaning wand removably coupled to the pivot assembly, and a canister assembly removably coupled to the pivot assembly. The canister assembly includes a first electrical connector connected to a power source, a dirt separation unit, and a suction motor electrically connected to the power source and in fluid communication with a dirty air inlet of the cleaning head, the cleaning wand, and the dirt separation unit. The vacuum cleaner also includes a second electrical connector on the pivot assembly. The vacuum cleaner is operable in an upright configuration and in a portable configuration. The cleaning wand is removable from the pivot assembly when the vacuum cleaner is in the upright configuration and when the vacuum cleaner is in the portable configuration.

16 Claims, 12 Drawing Sheets

(51) Int. Cl.
*A47L 5/30* (2006.01)
*A47L 9/28* (2006.01)

(56) References Cited

U.S. PATENT DOCUMENTS

| | | | | |
|---|---|---|---|---|
| 5,715,566 | A | 2/1998 | Weaver et al. | |
| 6,094,775 | A | 8/2000 | Behmer | |
| 6,311,366 | B1 | 11/2001 | Sepke et al. | |
| 7,152,274 | B2 | 12/2006 | Alford et al. | |
| 7,188,388 | B2 | 3/2007 | Best et al. | |
| 7,360,274 | B2 | 4/2008 | Park et al. | |
| 7,377,007 | B2 | 5/2008 | Best | |
| 7,594,296 | B2 | 9/2009 | Park | |
| 8,166,607 | B2 * | 5/2012 | Conrad | A47L 5/225 15/331 |
| 8,468,646 | B2 | 6/2013 | Yoo | |
| 8,567,006 | B2 | 10/2013 | Conrad | |
| 2002/0162188 | A1 * | 11/2002 | Harmen | A47L 9/1691 15/353 |
| 2006/0137128 | A1 | 6/2006 | Elsworthy et al. | |
| 2006/0213024 | A1 | 9/2006 | Lee et al. | |
| 2010/0139030 | A1 | 6/2010 | Yoo | |
| 2010/0229338 | A1 | 9/2010 | Conrad | |
| 2010/0251507 | A1 | 10/2010 | Conrad | |
| 2011/0219567 | A1 * | 9/2011 | Conrad | A47L 5/225 15/328 |
| 2011/0219568 | A1 | 9/2011 | Conrad | |
| 2011/0314629 | A1 | 12/2011 | Conrad | |
| 2012/0000030 | A1 | 1/2012 | Conrad | |
| 2012/0204378 | A1 | 8/2012 | Conrad | |
| 2014/0013537 | A1 * | 1/2014 | Kasper | A47L 9/16 15/353 |

FOREIGN PATENT DOCUMENTS

| | | |
|---|---|---|
| CN | 100376188 | 3/2008 |
| CN | 100376194 | 3/2008 |
| CN | 102188186 | 9/2011 |
| CN | 202699035 | 1/2013 |
| DE | 19708955 | 9/1998 |
| EP | 0683638 | 11/1995 |
| EP | 0862887 | 9/1998 |
| EP | 2684500 | 1/2014 |
| GB | 2343837 | 5/2000 |
| GB | 2401033 | 11/2004 |
| GB | 2403134 | 12/2004 |
| GB | 2424361 | 9/2006 |
| GB | 2425249 | 10/2006 |
| GB | 2436447 | 9/2007 |
| GB | 2437207 | 10/2007 |
| GB | 2455378 | 6/2009 |
| GB | 2456606 | 7/2009 |
| GB | 2466100 | 6/2010 |
| WO | 2008/070966 | 6/2008 |

* cited by examiner

VACUUM CLEANER INCLUDING A REMOVABLE CANISTER ASSEMBLY

CROSS-REFERENCE TO RELATED APPLICATIONS

This application claims priority to U.S. Provisional Patent Application No. 61/928,708, filed Jan. 17, 2014, the entire contents of which are incorporated by reference herein.

BACKGROUND

The present invention relates to floor cleaning devices and, more particularly, to vacuum cleaners including removable canister assemblies.

Upright vacuum cleaners are typically used to clean floor surfaces, such as carpeting. These types of vacuum cleaners, however, can be difficult to maneuver and operate in relatively confined areas. In addition, it is sometimes desirable to clean elevated surfaces, such as drapes, furniture, or steps, with an upright vacuum cleaner.

SUMMARY

In one embodiment, the invention provides a vacuum cleaner including a surface cleaning head having a dirty air inlet, a pivot assembly pivotally coupled to the surface cleaning head such that the pivot assembly is pivotable relative to the surface cleaning head, a cleaning wand removably coupled to the pivot assembly and having a handle, and a canister assembly removably coupled to the pivot assembly such that the canister assembly is supported above the surface cleaning head. The canister assembly includes a first electrical connector connected to a power source, a dirt separation unit, and a suction motor electrically connected to the power source and in fluid communication with the dirty air inlet, the cleaning wand, and the dirt separation unit. The vacuum cleaner also includes a second electrical connector on the pivot assembly. The vacuum cleaner is operable in an upright configuration where the canister assembly is attached to the pivot assembly and the first electrical connector is coupled with the second electrical connector. The vacuum cleaner is also operable in a portable configuration where the canister assembly is detached from the pivot assembly and the first electrical connector is detached from the second electrical connector. The cleaning wand is removable from the pivot assembly when the vacuum cleaner is in the upright configuration and when the vacuum cleaner is in the portable configuration.

In another embodiment, the invention provides a vacuum cleaner including a surface cleaning head having a dirty air inlet, and a pivot assembly pivotally coupled to the surface cleaning head such that the pivot assembly is pivotable relative to the surface cleaning head. The pivot assembly includes an electrical connector. The vacuum cleaner also includes a cleaning wand removably coupled to the pivot assembly and having a handle, and a canister assembly removably coupled to the pivot assembly such that the canister assembly is supported above the surface cleaning head. The canister assembly includes an electrical connector connected to a power source and the electrical connector of the pivot assembly, a dirt separation unit, and a suction motor electrically coupled to the power source and in fluid communication with the dirty air inlet, the cleaning wand, and the dirt separation unit. The canister assembly is removable from the pivot assembly while the cleaning wand is connected to the pivot assembly. The cleaning wand is removable from the pivot assembly while the canister assembly is connected to the pivot assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
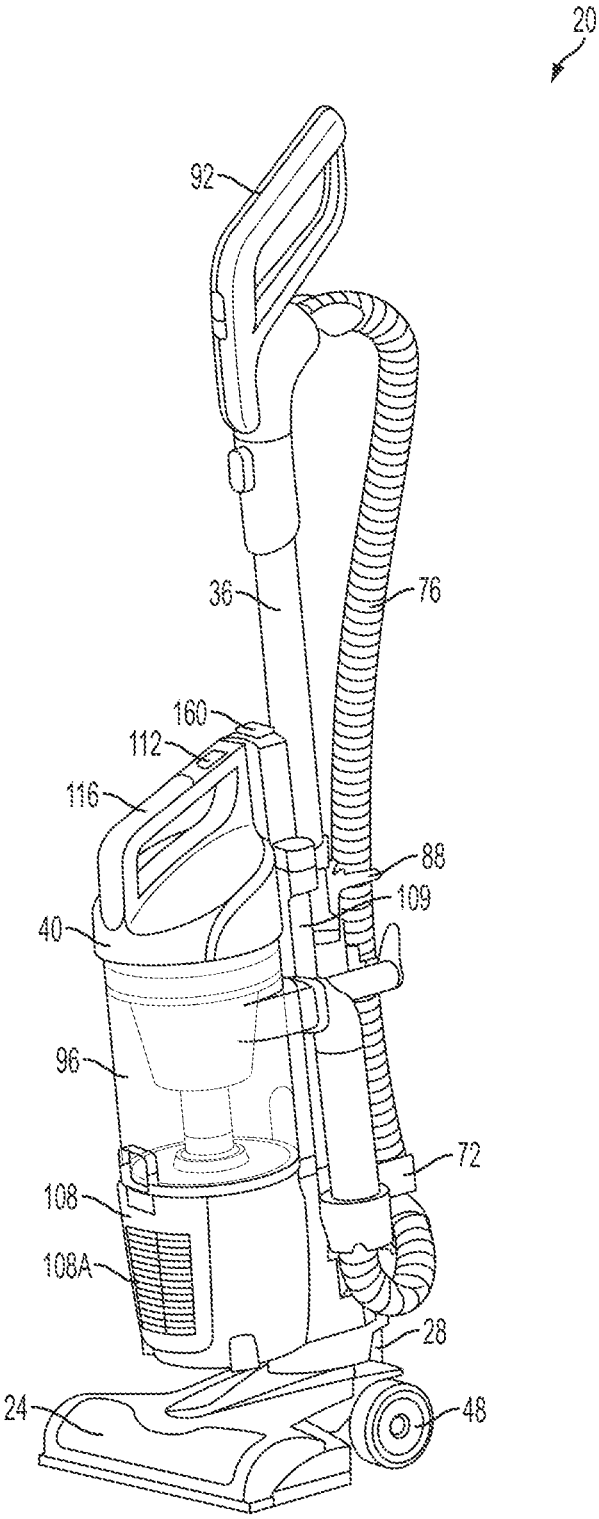
FIG. 1A is a perspective view of a vacuum cleaner embodying the invention, the vacuum cleaner including a surface cleaning head, an extension tube, an above floor cleaning wand, and a canister assembly.
Figure 1B:
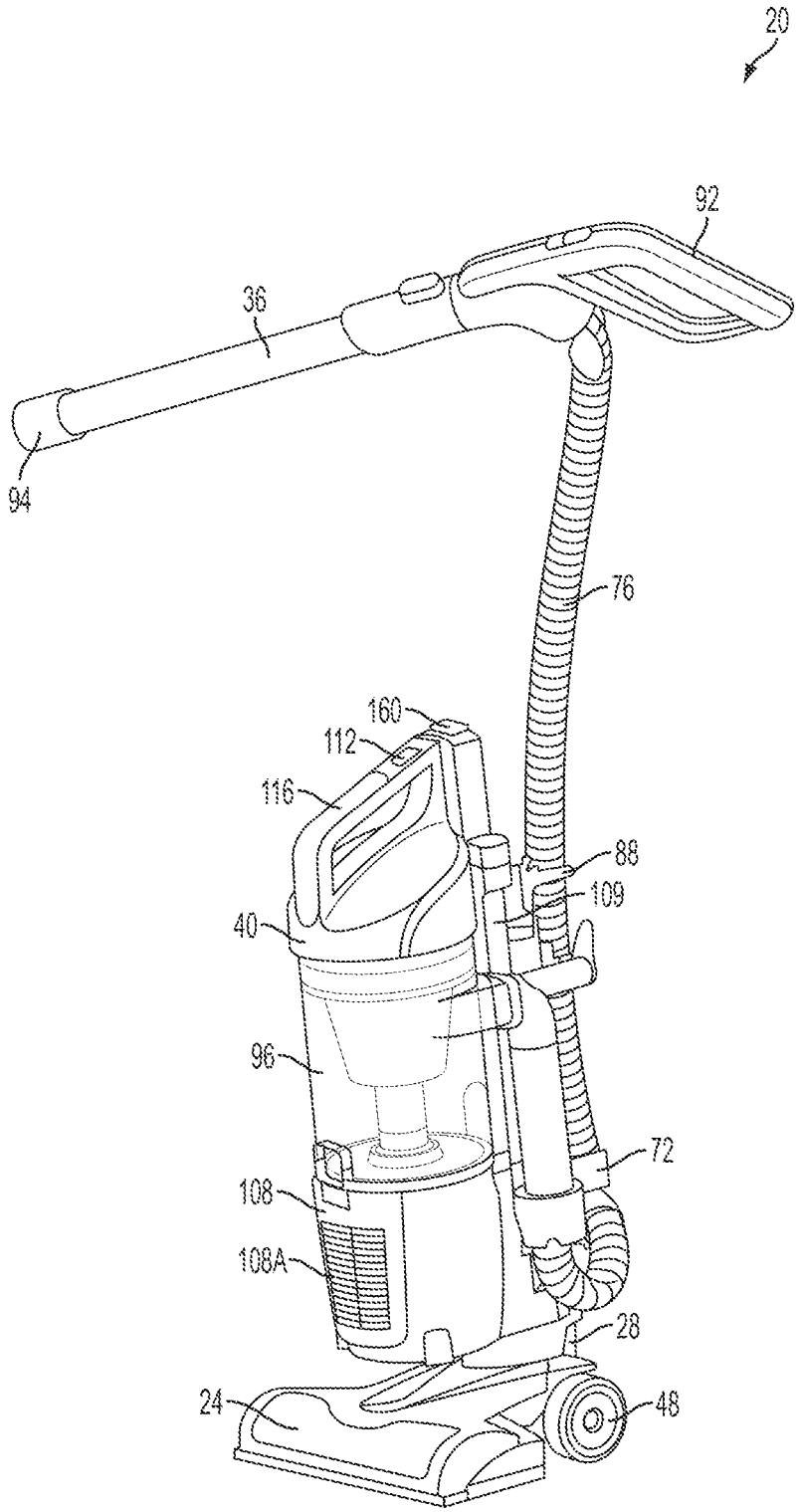
FIG. 1B is a perspective view of the vacuum cleaner with the cleaning wand disconnected from the extension tube.
Figure 2:
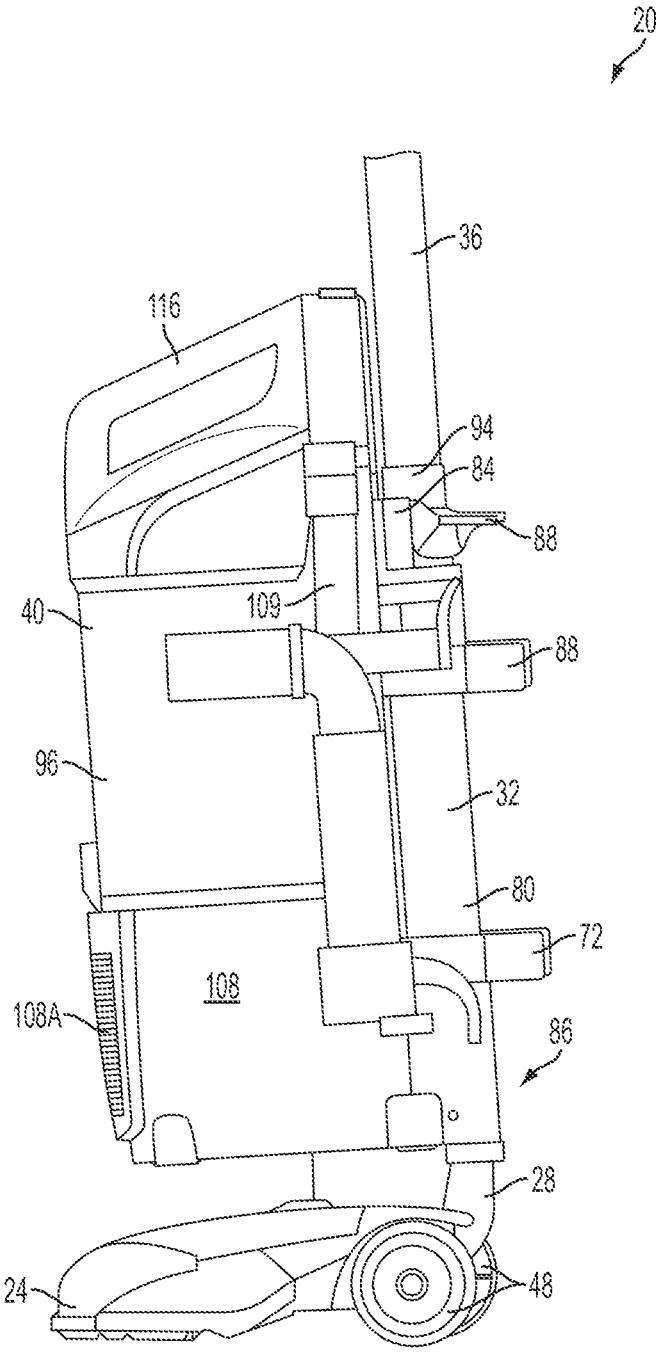
FIG. 2 is a side view of a portion of the vacuum cleaner.

FIGS. 1A-2 illustrate a vacuum cleaner 20. The illustrated vacuum cleaner 20 is an upright vacuum cleaner including a surface cleaning head 24, a pivoting connector 28, an extension tube 32, an above floor cleaning wand 36, and a canister assembly 40.

Figure 4:
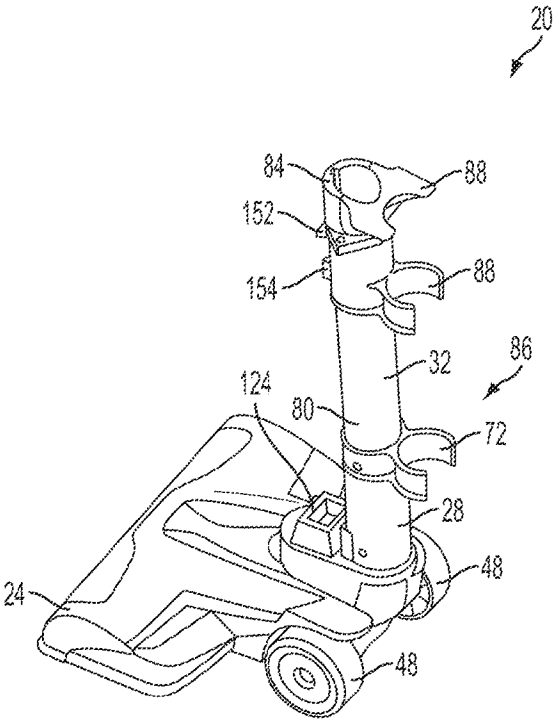
FIG. 4 is a perspective view of the vacuum cleaner with the canister assembly and the above floor cleaning wand removed.
Figure 3:
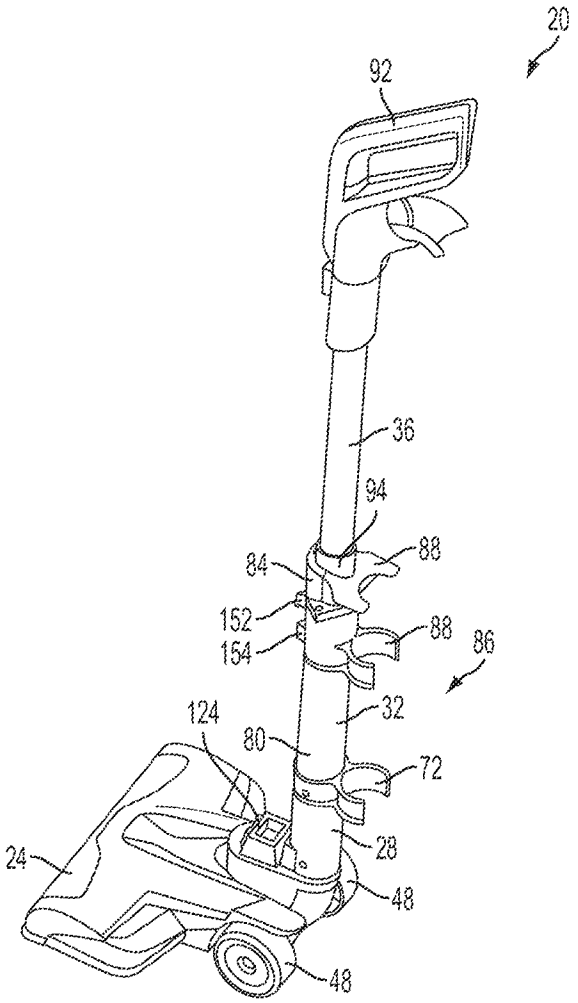
FIG. 3 is a perspective view of the vacuum cleaner with the canister assembly removed.

The vacuum cleaner 20 is operable in different configurations, or modes, by disconnecting various components of the vacuum cleaner 20 from each other. For example, the vacuum cleaner 20 is operable in a first, upright configuration when the surface cleaning head 24, the cleaning wand 36, and the canister assembly 40 are all connected together (as shown in FIG. 1A). In this configuration, the vacuum cleaner 20 is usable like a conventional upright vacuum cleaner. The vacuum cleaner 20 is also operable in a second, upright configuration where the cleaning wand 36 is disconnected from the extension tube 32 (as shown in FIG. 1B). In this configuration, the vacuum cleaner 20 is still generally connected together, but the cleaning wand 36 is usable apart from the remainder of the vacuum cleaner 20 to clean above floor surfaces (e.g., drapes, furniture, etc.) or harder to reach areas (e.g., stairs, corners, etc.). In addition, the vacuum cleaner 20 is operable in a third, portable or carry-along configuration by disconnecting the canister assembly 40 from the pivoting connector 28 and the extension tube 32 (as shown in FIG. 3). In this configuration, a user can carry the canister assembly 40 apart from the cleaning head 24, the extension tube 32, and the cleaning wand 36. The vacuum cleaner 20 is further operable in a fourth, above-floor configuration by disconnecting the canister assembly 40 and the cleaning wand 36 from the pivoting connector 28 and the extension tube 32 (as shown in FIG. 4). In this configuration, the canister assembly 40 and the cleaning wand 36 are usable separately from the cleaning head 24 and the extension tube 32 to clean above floor surfaces, such as steps, furniture, and drapes.

Figure 5:
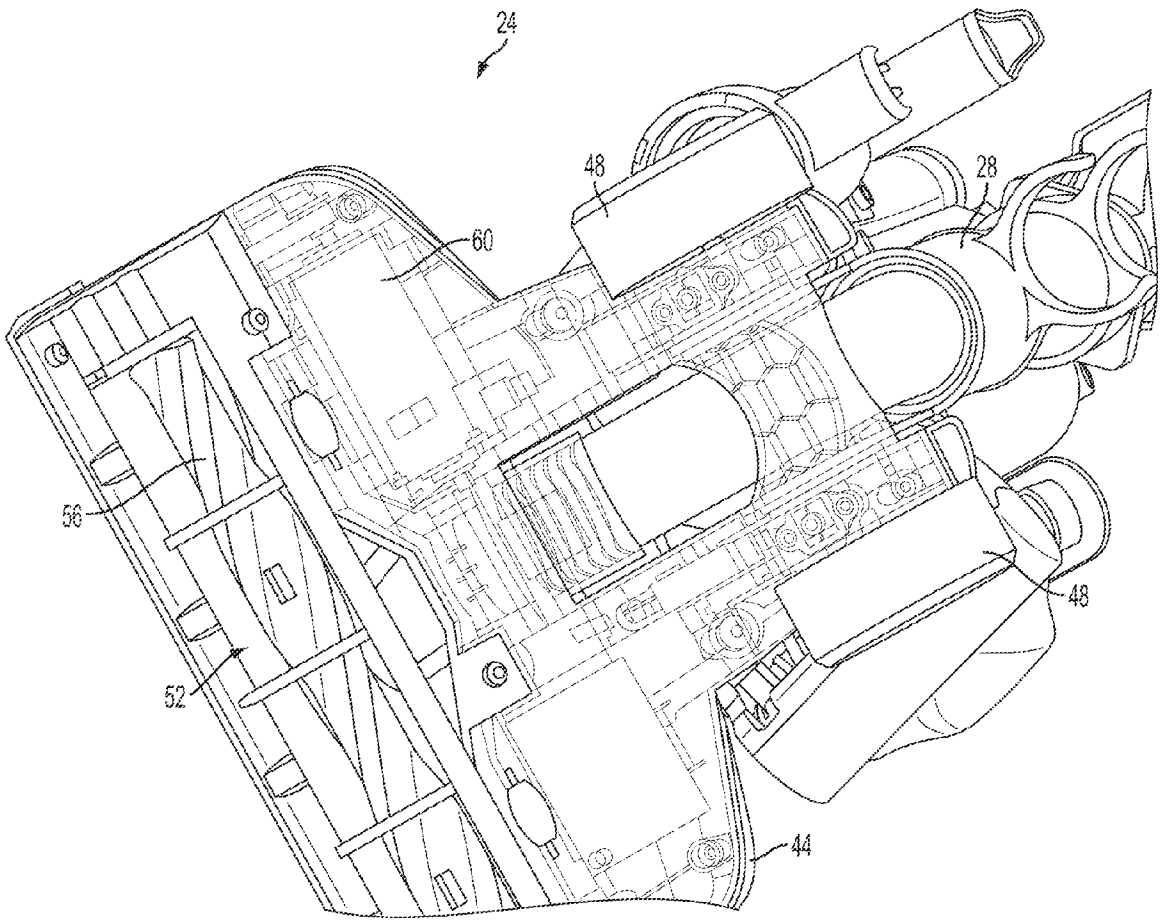
FIG. 5 is a bottom, partial cross-sectional view of the surface cleaning head.

As shown in FIG. 5, the surface cleaning head 24 includes a housing 44, two wheels 48 rotatably coupled to the housing 44, a dirty air inlet 52 formed in a bottom surface of the housing 44, a brush roll 56 rotatably coupled to the housing 44, and a brush roll motor 60 positioned within the housing 44 and coupled to the brush roll 56. The dirty air inlet 52 is in communication with the pivoting connector 28 to direct air drawn into the housing 44 to the pivoting connector 28. The brush roll 56 is aligned with and positioned above the dirty air inlet 52 to beat or scrub the surface beneath the dirty air inlet 52. The brush roll motor 60 is operable, when powered, to rotate the brush roll 56.

Figure 6:
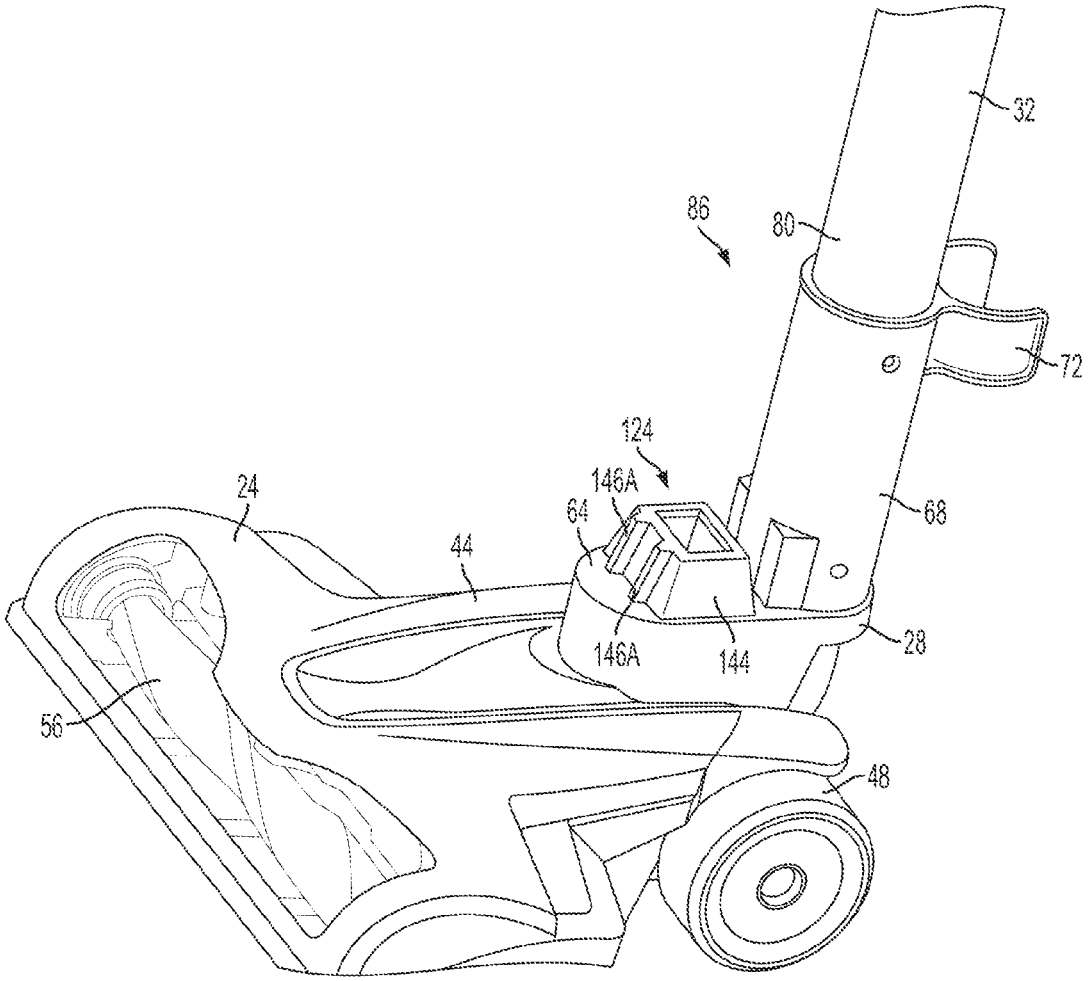
FIG. 6 is an enlarged perspective view of the surface cleaning head and a portion of the extension tube.

As shown in FIGS. 3 and 4, the pivoting connector 28 is pivotably attached to the surface cleaning head 24. The pivoting connector 28 includes a base 64 and a tube portion 68 extending perpendicularly from the base 64 (FIG. 6). The base 64 is configured to support the canister assembly 40. The tube portion 68 is configured to receive a portion of the extension tube 32 to direct air from the dirty air inlet 52 (FIG. 5) of the cleaning head 24 into the extension tube 32. The tube portion 68 also includes a guide member 72 to help guide a flexible hose 76 (FIGS. 1A and 1B) that extends between the cleaning wand 36 and the canister assembly 40. In the illustrated embodiment, the connector 28 pivots relative to the housing 44 of the cleaning head 24 such that the extension tube 32, the cleaning wand 36, and the canister assembly 40 are movable from a substantially upright, storage position (as shown in FIGS. 1A and 2) to a plurality of inclined, operating positions.

The extension tube 32 includes a first end 80 coupled to the pivoting connector 28 and a second end 84 coupled to the cleaning wand 36. The first end 80 is received in the tube portion 68 of the pivoting connector 28 such that the extension tube 32 and the pivoting connector 28 are pivotable as a unit relative to the surface cleaning head 24 between and including the upright position and the plurality of inclined positions. That is, the pivoting connector 28 and the extension tube 32 together constitute a pivot assembly 86 of the vacuum cleaner 20. The extension tube 32 also includes guide members 88 to help guide the flexible hose 76 (FIGS. 1A and 1B).

As shown in FIGS. 1A and 3, the above floor cleaning wand 36 is coupled to and extends from the second end 84 of the extension tube 32. The cleaning wand 36 includes a handle 92 on a distal end of the wand 36 opposite from the extension tube 32. The handle 92 is drivingly connected to the surface cleaning head 24 through the cleaning wand 36 and the extension tube 32 so that a user can manipulate (e.g., move and turn) the cleaning head 24 while grasping the handle 92. As noted above, the cleaning wand 36 is removable from the extension tube 32 when the vacuum cleaner 20 is operated in the above-floor configuration. In this configuration, a free end portion 94 of the wand 36 that connects to the extension tube 32 can be connected to an accessory tool (e.g., a crevice tool, an upholstery tool, a pet tool, etc.) to use the wand 36 apart from the cleaning head 24. The cleaning wand 36 is also removable from the extension tube 32 when the canister assembly 40 is disconnected from the pivot assembly 86 so that cleaning wand 36 and the canister assembly 40 can be carried apart and used separately from the pivot assembly 86 and the cleaning head 24.

Figure 9:
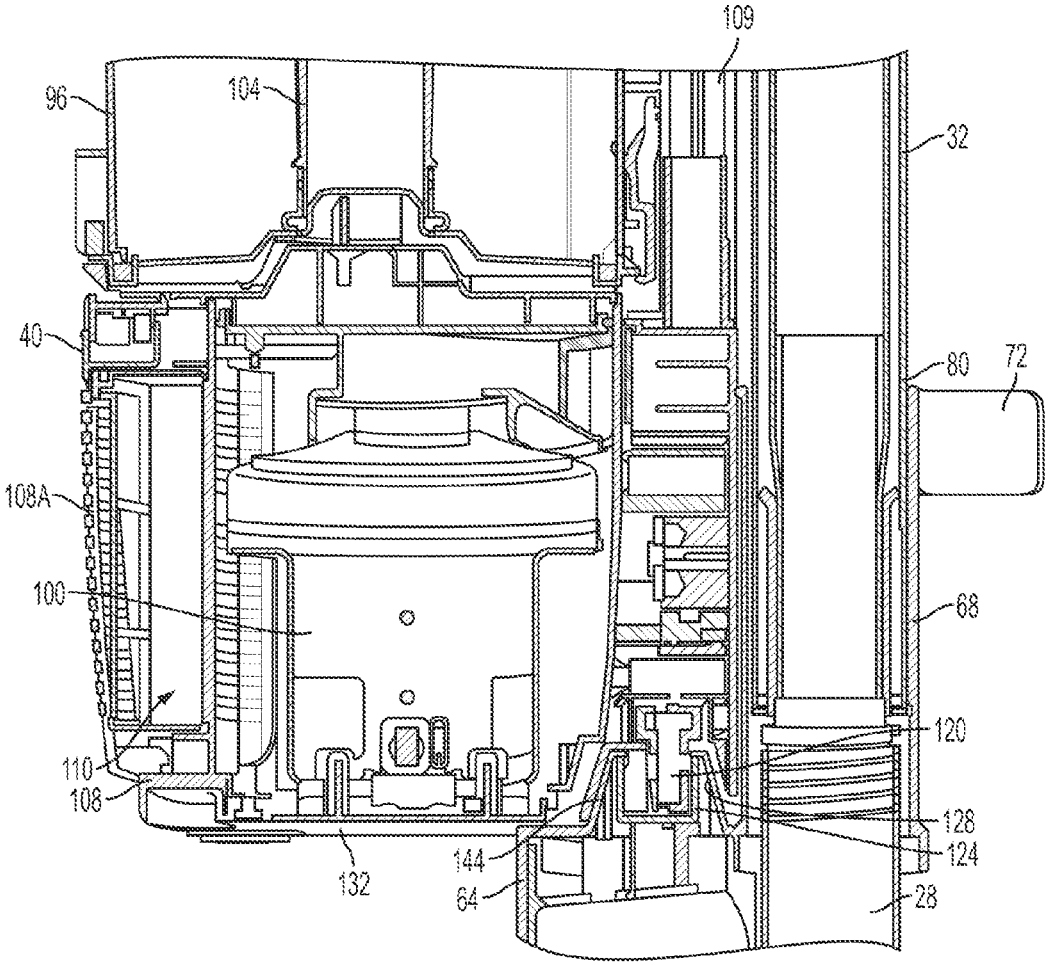
FIG. 9 is a cross-sectional view of a portion of the extension tube and a portion of the canister assembly.

As shown in FIGS. 1 and 2, the canister assembly 40 is removably coupled to the pivoting connector 28 and the extension tube 32 such that the canister assembly 40 is supported above the surface cleaning head 24. In other embodiments, the canister assembly 40 may be supported by the pivoting connector 28 and the extension tube 32 in other orientations relative to the surface cleaning head 24. The canister assembly 40 includes a dirt separation unit 96 and a suction motor 100 (FIG. 9). In the illustrated embodiment, the dirt separation unit 96 includes a cyclone 104 to separate dirt and dust particles from air that is drawn into the vacuum cleaner 20. In other embodiments, the dirt separation unit 96 may include a bag, one or more filters, and/or other suitable dirt separation devices.

As shown in FIG. 9, the suction motor 100 is positioned within a housing 108 that extends generally beneath and behind the dirt separation unit 96. The suction motor 100 is in fluid communication with the dirt separation unit 96 and is operable to generate a suction force to draw air into the dirt separation unit 96. As the air enters the dirt separation unit 96, the air circulates within the cyclone 104 to separate relatively large particles out of the air. The air is then directed through a pre-motor filter located in a cap of the dirt separation unit 96 (above the cyclone 104) to separate smaller particles out of the air. After passing through the filter, the air is directed into a spine 109 of the housing 108 located behind the dirt separation unit 96, through a motor chamber 110 of the housing 108 located beneath the dirt separation unit 96, and back into the environment through vents 108A formed in the housing 108.

Referring back to FIGS. 1 and 2, the dirt separation unit 96 is separable from the suction motor 100 and the housing 108 to facilitate, among other things, emptying the dirt separation unit 96. In the illustrated embodiment, the dirt separation unit 96 includes a push button 112 that is actuatable by a user to release a latch that secures the separation unit 96 to the housing 108. The dirt separation unit 96 also includes a handle 116 to facilitate grasping and carrying the separation unit 96 apart from the suction motor 100. The handle 116 also facilitates carrying the canister assembly 40 when the dirt separation unit 96 is connected to the suction motor 100 and the housing 108, and carrying the vacuum cleaner 20 when the canister assembly 40 is connected to the pivoting connector 28 and the extension tube 32.

Referring to FIGS. 6-9, the vacuum cleaner 20 also includes two electrical connectors 120, 124 that electrically connect the canister assembly 40 to the surface cleaning head 24. The canister assembly 40 is connected to a power source that powers and drives the suction motor 100. In some embodiments, the power source may be a wall outlet that is connected to the canister assembly 40 by a cord. In other embodiments, the power source may be a battery pack supported by or positioned within the canister assembly 40. In order to drive the brush roll motor 60 (FIG. 5) inside the cleaning head 24, the cleaning head 24 is also connected to the power source through the canister assembly 40.

Figure 8:
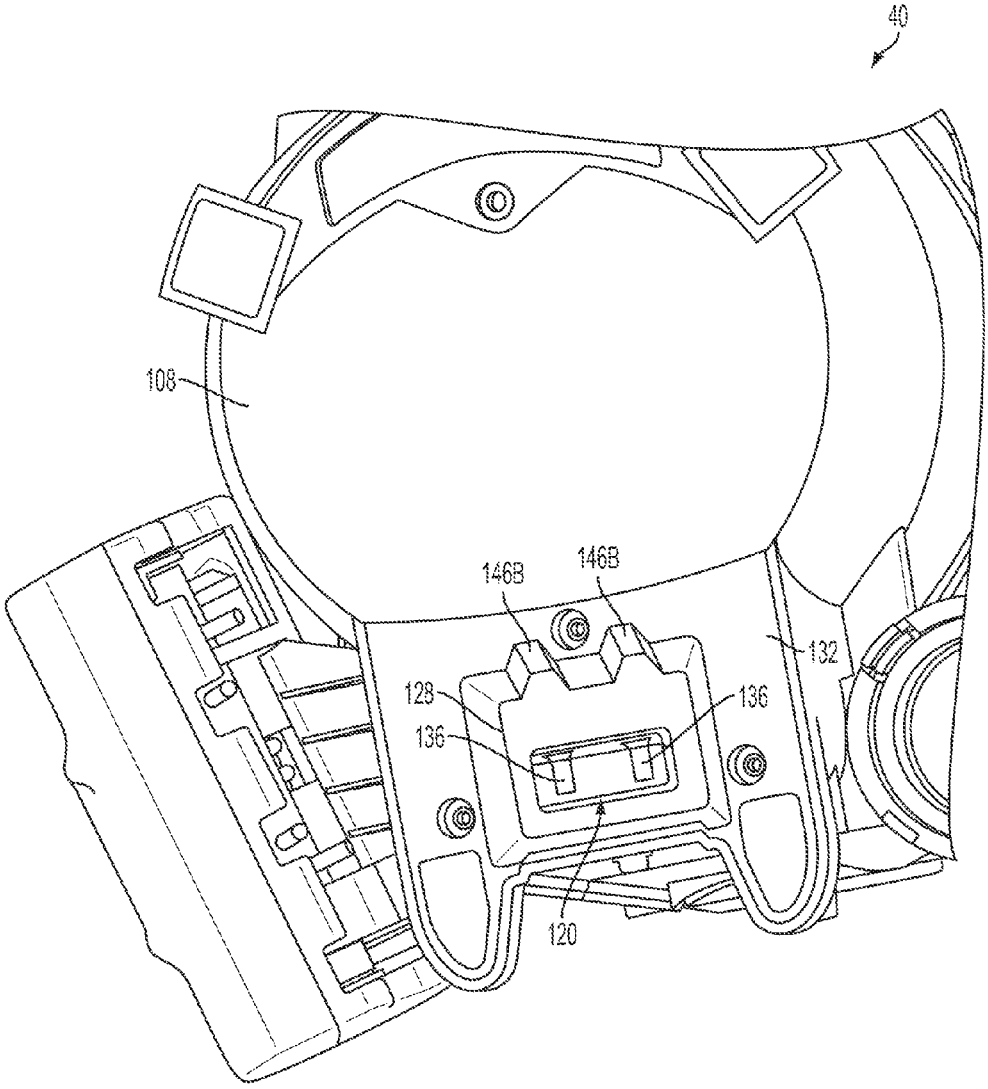
FIG. 8 is a bottom view of the canister assembly.

As shown in FIG. 8, the first electrical connector 120 is part of the canister assembly 40. In the illustrated embodiment, the first electrical connector 120 is positioned in a recess 128 formed in a bottom surface 132 of the canister assembly 136. The bottom surface 132 is a surface of the housing 108 beneath the dirt separation unit 96 and the motor 100 when the vacuum cleaner 20 is oriented in the upright configuration (FIGS. 1A and 1B). In other embodiments, the first electrical connector 120 may be positioned elsewhere on the canister assembly 40. The illustrated first electrical connector 120 includes two spaced apart receptacles 136 that receive the second electrical connector 124.

Figure 7:
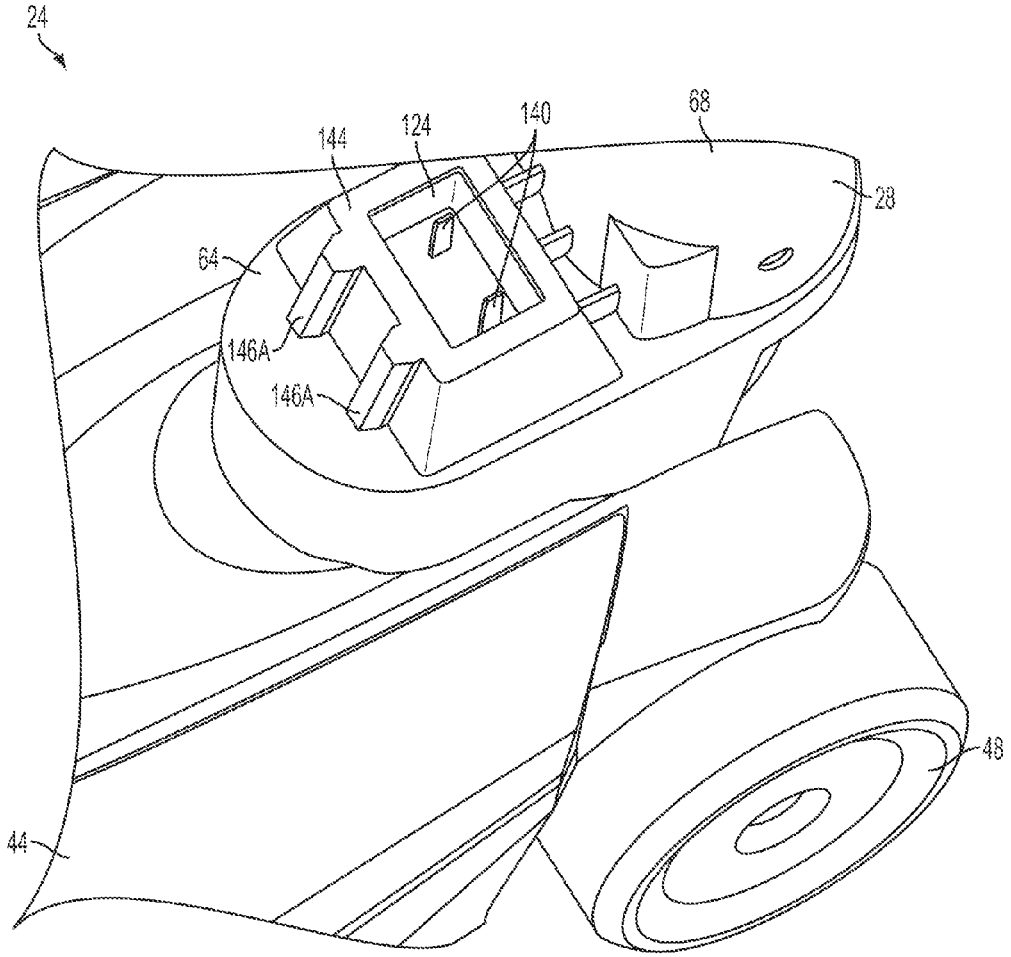
FIG. 7 is an enlarged top view of a portion of the surface cleaning head.

As shown in FIGS. 6 and 7, the second electrical connector 124 is part of the pivot assembly 86 and, more particularly, part of the pivoting connector 28. In other embodiments, the second electrical connector 124 may be part of the extension tube 32. The illustrated second electrical connector 124 extends upwardly from the base 64 of the pivoting connector 28 and includes two terminals 140 that plug into the receptacles 136 of the first electrical connector 120. A boss 144 formed on the base 64 supports and surrounds the terminals 140. The boss 144 is shaped and sized to be received in the recess 128 of the canister assembly 40 to help properly orient the canister assembly 40 on the base 64 when connecting the first and second electrical connectors 120, 124 together. In the illustrated embodiment, the boss 144 includes projecting features 146A (e.g., rails) that are received in corresponding receiving features 146B (e.g., grooves) of the recess 128 (FIG. 8) to orient and inhibit shifting of the canister assembly 40.

In the illustrated embodiment, the receptacles 136 of the first electrical connector 120 are female terminals, and the terminals 140 of the second electrical connector 124 are spade terminals. In other embodiments, the first electrical connector 120 may include spade terminals, and the second electrical connector 124 may include female terminals. Additionally or alternatively, the terminals 120, 124 may be other types of electrical connectors, such as pin-socket connectors, face-contact connectors, and the like.

FIG. 9 illustrates the second electrical connector 124 plugged into the first electrical connector 120. In other embodiments, the relative positions of the first and second electrical connectors 120, 124 may be reversed so that the canister assembly 40 plugs into the pivoting connector 28 (or the extension tube 32). When connected or attached together, the first electrical connector 120 supplies power to the brush roll motor 60 (FIG. 5) through the second electrical connector 124. When the canister assembly 40 is disconnected or detached from the pivoting connector 28 (e.g., when the vacuum cleaner 20 is in the portable and above-floor configurations), the brush roll motor 60 is not powered.

Figure 10:
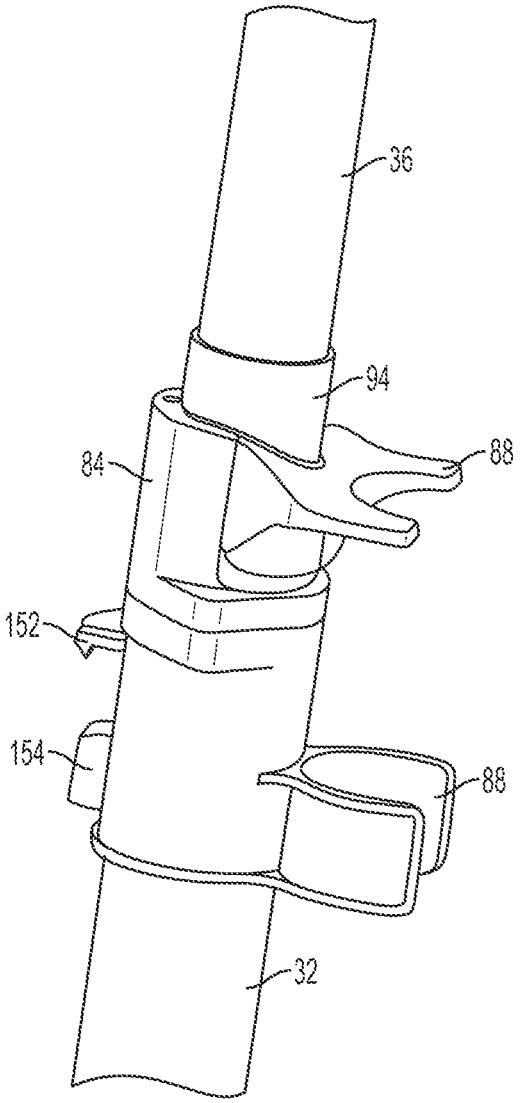
FIG. 10 is an enlarged perspective view of a portion of the extension tube and a portion of the above floor cleaning wand.
Figure 11:
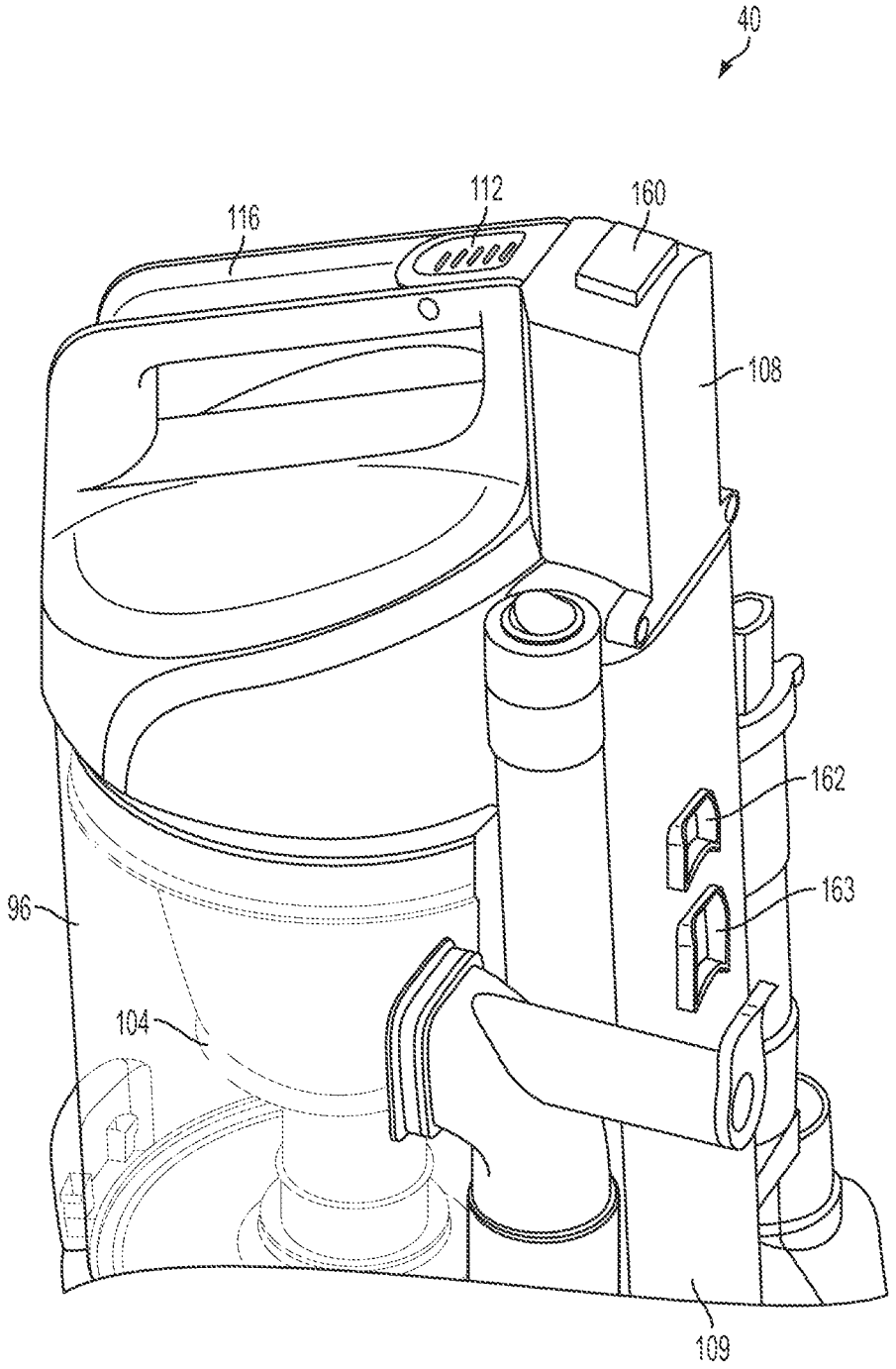
FIG. 11 is an enlarged perspective view of a portion of the canister assembly.
Figure 12:
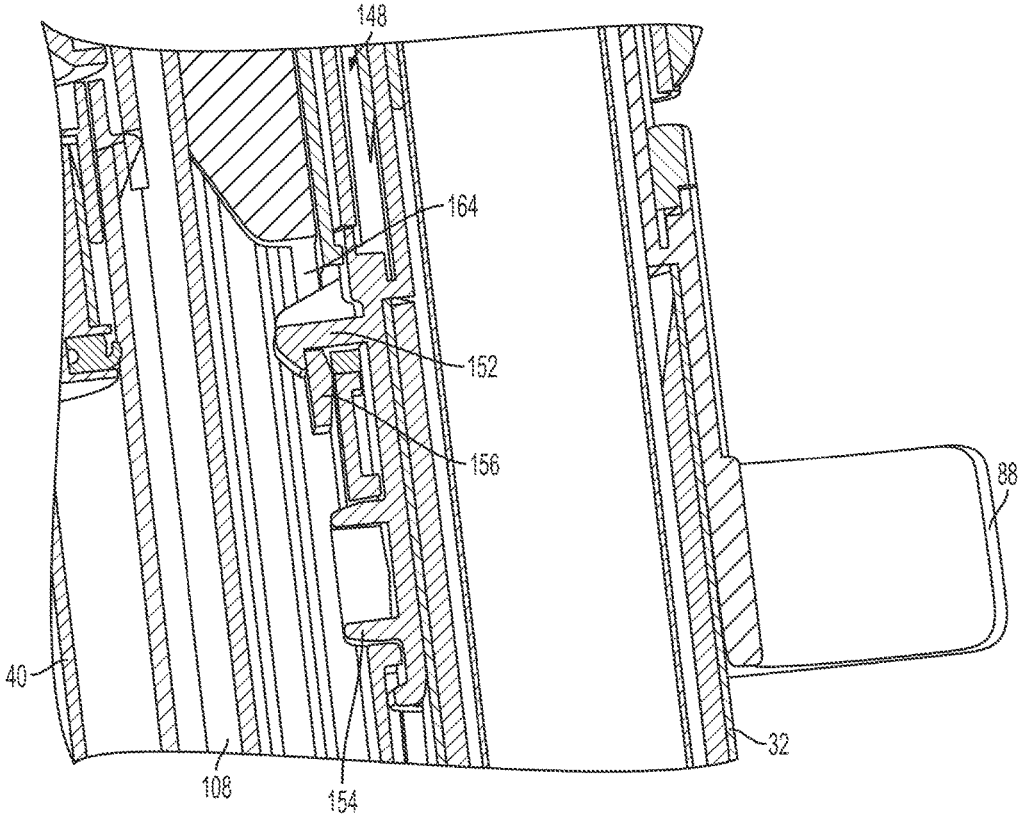
FIG. 12 is a cross-sectional view of a portion of the extension tube and a portion of the canister assembly.

Referring to FIGS. 10-12, the vacuum cleaner 20 further includes a latch mechanism 148 to releasably secure the canister assembly 40 to the extension tube 32. The latch mechanism 148 is spaced apart from the electrical connectors 120, 124 so that the canister assembly 40 is connected to the pivoting connector 28 and the extension tube 32 at two discrete locations. In the illustrated embodiment, the latch mechanism 148 is adjacent the second end 84 of the extension tube 32 so that the second electrical connector 124 is located between the surface cleaning head 24 and the latch mechanism 148. In other embodiments, the positions of the latch mechanism 148 and the electrical connectors 120, 124 may be reversed (i.e., the latch mechanism 148 may be adjacent the first end 80 of the extension tube 32, and the electrical connectors 120, 124 may be adjacent the second end 84 of the extension tube 32).

The illustrated latch mechanism 148 includes a first projection 152, a second projection 154, a receiving plate 156, and an actuator 160. In the illustrated embodiment, the first projection 152 is formed as a hooked member, and the second projection 154 is formed as a boss. In some embodiments, the second projection 154 may be omitted. As shown in FIG. 10, the first and second projections 152, 154 extend radially from the second end 84 of the extension tube 32. The projections 152, 154 are shaped and sized to extend into corresponding apertures 162, 163 (FIG. 11) formed in the spine 109 of the housing 108. The first projection 152 is selectively engaged by the receiving plate 156 to releasably secure the canister assembly 40 to the pivot assembly 86. The second projection 154 helps stabilize the canister assembly 40 relative to the pivot assembly 86.

As shown in FIG. 12, the receiving plate 156 is positioned in the housing 108 of the canister assembly 40 and defines an aperture 164. The aperture 164 receives the first projection 152 to secure the canister assembly 40 to the extension tube 32. As shown in FIG. 11, the actuator 160 extends from an upper surface of the housing 108 and is coupled to the receiving plate 156. The actuator 160 is operable (e.g., depressible by a user) to move the receiving plate 156 relative to the canister assembly 40 (downward in FIG. 12) so that the receiving plate 156 disengages the projection 152. When disengaged, the canister assembly 40 can be lifted off of the pivoting connector 28 and the extension tube 32 by a user. A forcing member (e.g., a spring) may be coupled to the receiving plate 156 to urge the receiving plate 156 into engagement with the projection 152 (upward in FIG. 12).

In other embodiments, one or both of the projections 152, 154 may extend from the canister assembly 40, and the aperture 164 may be formed in the extension tube 32. In such embodiments, the actuator 160 may be operable to move the first projection 152 relative to the canister assembly 40 and out of engagement with the extension tube 32. In further embodiments, other suitable latch or connecting mechanisms may be employed.

In operation while the vacuum cleaner 20 is in the first configuration (FIG. 1A), the suction motor 100 draws air and dirt through the dirty air inlet 52 of the cleaning head 24, through the pivoting connector 28, through the extension tube 32, through the wand 36, through the flexible hose 76, and into the dirt separation unit 96. The dirt separation unit 96 then separates the dirt from the air and expels the cleaned air back into the environment. In this configuration, the canister assembly 40 is attached to the pivoting connector 28, and the first electrical connector 120 is coupled with the second electrical connector 124. As such, power is supplied to the brush roll motor 60 to rotate the brush roll 56 relative to the cleaning head housing 44.

In operation while the vacuum cleaner 20 is in the second configuration (FIG. 1B), the cleaning wand 36 is disconnected from the pivot assembly 86 so that the suction motor 100 draws air and dirt through the free end 94 of the cleaning wand 36 (or an accessory tool connected to the wand 36), rather than through the dirty air inlet 52 of the cleaning head 24. Similar to the first configuration, the air and dirt are then directed through the flexible hose 76, into the dirt separation unit 96, and back into the environment.

In operation while the vacuum cleaner 20 is in the third configuration, the suction motor 100 again draws air and dirt through the dirty air inlet 52 of the cleaning head 24, through the pivoting connector 28, through the extension tube 32, through the wand 36, through the flexible hose 76, and into the dirt separation unit 96. In this configuration, however, the canister assembly 40 is detached from both the pivoting connector 28 and the extension tube 32, and the first electrical connector 120 is detached from the second electrical connector 124. As such, power is not supplied to the brush roll motor 60, and the brush roll 56 does not rotate.

In operation while the vacuum cleaner 20 is in the fourth configuration, the suction motor 100 draws air and dirt through the free end 94 of the cleaning wand 36 (or an accessory tool connected to the wand 36), through the flexible hose 76, and into the dirt separation unit 96. In this configuration, the surface cleaning head 24, the pivoting connector 28, and the extension tube 32 are not used.

Various features and advantages of the invention are set forth in the following claims.

What is claimed is:

1. A vacuum cleaner comprising:

a surface cleaning head including a dirty air inlet;

a pivoting connector pivotally coupled to the surface cleaning head such that the pivoting connector is pivotable relative to the surface cleaning head, the pivoting connector having a base and a tube portion extending from the base;

a cleaning wand removably coupled to the tube portion of the pivoting connector and including a handle;

a canister assembly removably coupled to the base of the pivoting connector such that the canister assembly is supported above the surface cleaning head, the canister assembly including a first electrical connector connected to a power source, a dirt separation unit, and a suction motor electrically connected to the power source and in fluid communication with the dirty air inlet, the cleaning wand, and the dirt separation unit; and a second electrical connector on the pivot assembly;

wherein the vacuum cleaner is operable in an upright configuration where the canister assembly is attached to the base and the first electrical connector is coupled with the second electrical connector, and wherein the vacuum cleaner is operable in a portable configuration where the canister assembly is detached from the base and the first electrical connector is detached from the second electrical connector, and wherein the cleaning wand is removable from the tube portion when the vacuum cleaner is in the upright configuration and when the vacuum cleaner is in the portable configuration.

2. The vacuum cleaner of claim 1, wherein the second electrical connector is located on the base.

3. The vacuum cleaner of claim 1, further comprising a latch mechanism on the pivoting connector, wherein the latch mechanism releasably secures the canister assembly to the pivoting connector.

4. The vacuum cleaner of claim 3, wherein the second electrical connector is spaced apart from the latch mechanism.

5. The vacuum cleaner of claim 4, wherein the second electrical connector is located between the surface cleaning head and the latch mechanism.

6. The vacuum cleaner of claim 3, wherein the latch mechanism includes a projection extending radially from the pivoting connector, a receiving plate supported on the canister assembly and defining an aperture, the aperture receives the projection to secure the canister assembly to the tube portion, and an actuator coupled to the receiving plate, the actuator operable to move the receiving plate relative to the canister assembly to disengage the receiving plate from the projection.

7. The vacuum cleaner of claim 1, wherein the first electrical connector is positioned in a recess formed in a bottom surface of the canister assembly.

8. The vacuum cleaner of claim 7, wherein the pivoting connector includes a boss surrounding the second electrical connector, and wherein the boss fits within the recess formed in the bottom surface of the canister assembly.

9. The vacuum cleaner of claim 1, further comprising a flexible hose extending between the cleaning wand and the dirt separation unit of the canister assembly to direct air from the cleaning wand to the canister assembly.

10. The vacuum cleaner of claim 1, wherein the dirt separation unit is separable from the first electrical connector and the suction motor.

11. A vacuum cleaner comprising:

a surface cleaning head including a dirty air inlet;

a pivoting connector pivotally coupled to the surface cleaning head such that the pivoting connector is pivotable relative to the surface cleaning head, the pivoting connector including an electrical connector, a base and a tube portion extending from the base;

a cleaning wand removably coupled to the tube portion of the pivoting connector and including a handle and a wand portion extending from the handle that is at least 1.5 times longer than the handle; and a canister assembly removably coupled to the base of the pivoting connector such that the canister assembly is supported above the surface cleaning head, the canister assembly including an electrical connector connected to a power source and removably coupled to the electrical connector of the pivoting connector, a dirt separation unit, and a suction motor electrically coupled to the power source and in fluid communication with the dirty air inlet, the cleaning wand, and the dirt separation unit;

wherein the canister assembly is removable from the base while the cleaning wand is connected to the tube portion, and wherein the cleaning wand is removable from the tube portion while the canister assembly is connected to the base.

12. The vacuum cleaner of claim 11, wherein the electrical connector of the pivoting connector is located on the base.

13. The vacuum cleaner of claim 11, further comprising a latch mechanism on the pivoting connector, wherein the latch mechanism releasably secures the canister assembly to the pivoting connector.

14. The vacuum cleaner of claim 13, wherein the electrical connector of the pivoting connector is located between the surface cleaning head and the latch mechanism.

15. The vacuum cleaner of claim 11, wherein the electrical connector of the canister assembly is positioned in a recess formed in a bottom surface of the canister assembly.

16. The vacuum cleaner of claim 15, wherein the pivoting connector includes a boss surrounding the electrical connector of the pivoting connector, and wherein the boss fits within the recess formed in the bottom surface of the canister assembly.

* * * * *